United States Patent [19]

Sova

[11] 4,294,443

[45] Oct. 13, 1981

[54] WORKPIECE RETAINER

[76] Inventor: Alex W. Sova, 19951 Houghton, Detroit, Mich. 48219

[21] Appl. No.: 188,892

[22] Filed: Sep. 19, 1980

[51] Int. Cl.[3] ..... B25B 1/24

[52] U.S. Cl. ..... 269/108; 269/130; 269/244; 269/266

[58] Field of Search ..... 269/130-132, 269/108, 265, 266, 240, 244, 246, 253, 257; 125/35

[56] References Cited

U.S. PATENT DOCUMENTS

| | | | |
|---|---|---|---|
| 1,966,391 | 7/1934 | Hill | 269/108 |
| 3,224,754 | 12/1965 | Graham | 269/130 |
| 3,593,402 | 7/1971 | Mori | 269/131 |
| 3,664,320 | 5/1972 | Allen et al. | 125/35 |
| 4,011,979 | 3/1977 | Hagen et al. | 269/132 X |

*Primary Examiner*—Robert C. Watson

*Attorney, Agent, or Firm*—Barnes, Kisselle, Raisch & Choate

[57] ABSTRACT

A clamping retention structure for rough stones to enable mechanical operations to be performed which includes spaced support bars on a common threaded shaft and a link chain anchored at each end on one bar and looped around the other bar. Stone engaging teeth in spaced relation on the chain are stabilized by cross slides so that turning the threaded shaft in one direction forces the bars apart and tightens the chain to force the teeth into tight engagement with the stone.

7 Claims, 4 Drawing Figures

WORKPIECE RETAINER

FIELD OF INVENTION

In the cutting of semi-precious stones, a device for retaining the rough stone for the purpose of sawing slabs from the stone or performing other mechanical operations on the stone.

BACKGROUND OF THE INVENTION

In the cutting and polishing of jewel stones, such as opals and the like, the starting piece is a rough stone which is difficult to grasp mechanically so that mechanical operations can be performed such as the saw cutting of slabs and similar machining. One problem is gripping the stone in such a way as to avoid interference with the machine operation such as a circular saw.

The present invention is directed to holding a piece of stone which has one flat side resulting from an initial saw cut which splits the original stone into two pieces. An object is to hold the stone securely from the flat side leaving the remainder projecting freely so it can be exposed to a saw or other machining operation. Another object is the provision of a retention device which will adapt itself to varying rough contours of individual stones and which will anchor the stones securely in a mechanical grip. A further object is the provision of a holding device for rough stones which can be made in various sizes for small, medium or large pieces of stone.

Other objects of the invention will be apparent in the following description and claims in which the principles of the invention are set forth together with details of construction and operation to enable persons skilled in the art to practice the invention, all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE INVENTION

Figure 1:
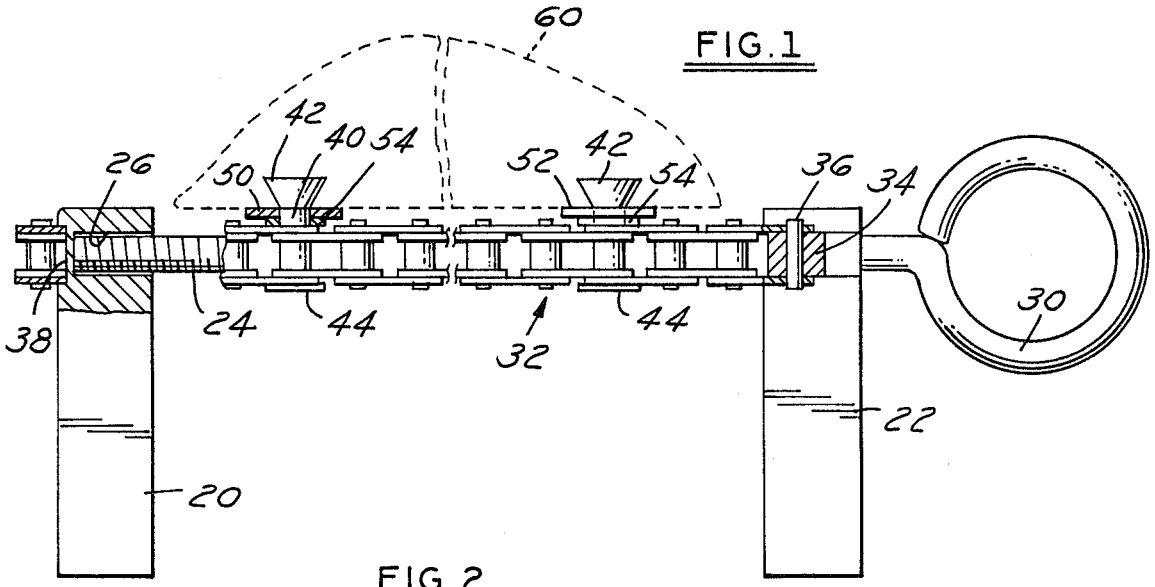
FIG. 1, a top view of the retention device partially in section.

With reference to the drawings, in FIG. 1, two metal support members in the form of bars 20 and 22 are shown in spaced relation, each with aligned bores to receive a threaded shaft 24. Bar 20 has a bore 26 which is unthreaded so that the shaft 24 is rotatably socketed and can rotate freely therein. Bar 22 has a threaded bore 28 and the shaft 24 has a loop 30 to serve as a handle to turn the shaft.

A length of link chain 32 of the type used in bicycles has its two ends anchored pivotally on wings 34 carrying pins 36. The bight of the chain 32 passes around bar 20 which has a shallow retention groove 38 to serve as a track for the chain.

Figure 3:
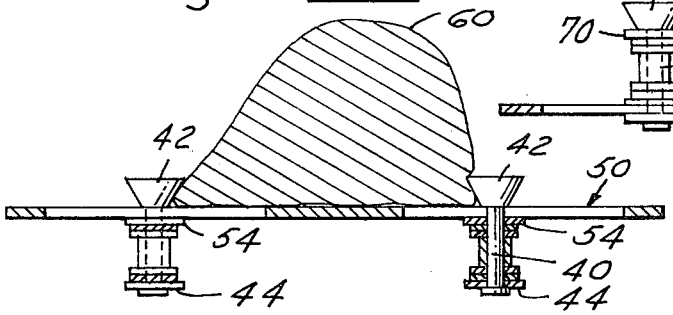
FIG. 3, a section of the device on line 3—3 of FIG. 2 showing a stone in place, FIG. 4, a modification of the construction.

At four points on the chain, a pivot 40 in the chain is extended and has head 42 at one end to serve as a tooth to engage a stone. The other end of these extended pivots is riveted over a washer 44 as shown in FIGS. 1 and 3 or otherwise retained. Spacer and slide bars 50 and 52 have closed slots 54 at each end through which the extended pivots pass below the enlarged heads 42. A washer 54 may underlie the bars on the chain side. While two bars are shown, a single bar could be used.

Figure 2:
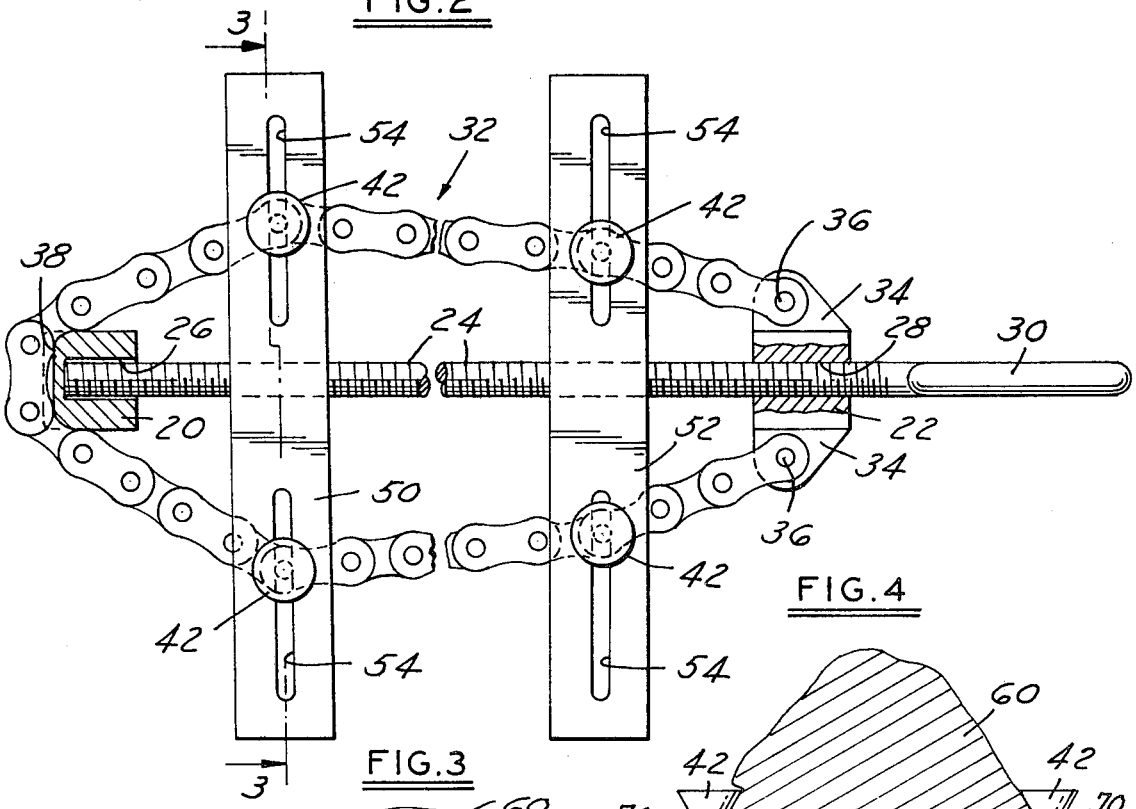
FIG. 2, a side view of the device.

With particular reference to FIG. 2, it will be seen that turning the threaded shaft in one direction will move bar 22 toward bar 20 and, in the other direction, will move bar 22 away from bar 20. Moving the bars apart will tighten the chain loop and moving them toward each other will enlarge the loop.

A stone 60 can be placed on the cross-bars 50–52, when the chain is enlarged and the tightening of the chain will cause the teeth to bite into the stone to grip it securely. Where the stone has an acute angle, as shown at the left in FIG. 3, the inverted cone shape of the tooth 42 will engage the corner of the stone. Where the stone has close to a right angle or even an obtuse angle, then it is best to notch in the stone 60 as shown at the right side of FIG. 3. Once the teeth 42 are engaged, the tightening of the chain will draw the flat face of the stone down into tight engagement with the cross-bars 50–52. The cross-bars support the stone while the teeth are properly positioned prior to tightening of the chain.

When the stone is secured in the retention device, the bars 20–22 can be gripped in a vice and the stone subjected to the mechanical operation selected such as sawing.

Figure 4:
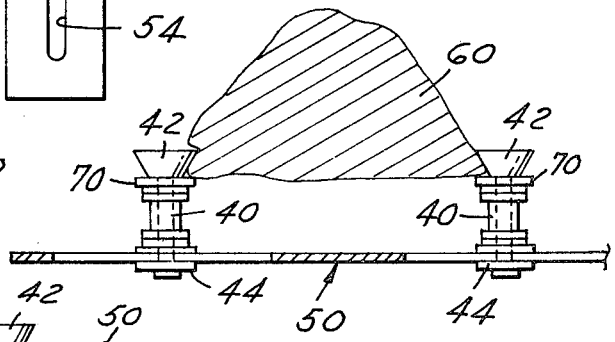

In FIG. 4, a modified structure is illustrated wherein the bars 50–52 are located on the side of the chain away from the stone. At the base of each inverted cone forming the teeth 42 is an enlarged washer 70 which serves to support the edge of the stone while the cross-bars are on the other side of the stone to stabilize the assembly. Otherwise, the operation of this modification is the same as that described in connection with FIGS. 1 to 3.

The term "pivoted link chain" is used to designate a bicycle type chain with links which are connected by pivots. The device described and illustrated can be made in various sizes with different size chains which are available.

What I claim is:

1. A device for holding irregular stones for the purpose of performing mechanical operations thereon which comprises:

(a) spaced support members, (b) means mechanically associating said members operable to move said members toward and away from each other, (c) a length of flexible member mechanically associated with a portion of each of said members to form a closed loop, said flexible member lying essentially in a single plane, said flexible member having two ends secured to one of said support members and a portion passing around a portion of the other support member, and (d) a plurality of means on said flexible member in opposed positions to engage a stone positioned in the loop of said flexible member, whereby when said members are moved away from each other the loop is tightened to secure a stone to said chain.

2. A device for holding irregular stones for the purpose of performing mechanical operations thereon which comprises:

(a) spaced support members, (b) means mechanically associating said members operable to move said members toward and away from each other, (c) a length of flexible member mechanically associated with a portion of each of said members to form a closed loop, said flexible member lying essentially in a single plane, (d) a plurality of means on said flexible member in opposed positions to engage a stone positioned in the loop of said flexible member, (e) said flexible member comprising a pivoted link chain and said means to engage said stone comprising teeth members mounted on one side of said chain, said teeth members comprising inverted cones mounted an extended pivot means between adjacent links of said chain, whereby when said members are moved away from each other the loop is tightened to secure a stone to said chain.

3. A device for holding irregular stones for the purpose of performing mechanical operations thereon which comprises:

(a) spaced support members, (b) means mechanically associating said members operable to move said members toward and away from each other, (c) a length of flexible member mechanically associated with a portion of each of said members to form a closed loop, said flexible member lying essentially in a single plane, (d) a plurality of means on said flexible member in opposed positions to engage a stone positioned in the loop of said flexible member, (e) one or more stabilizer bars mounted in between said support members and associated at each end in a sliding relationship with opposed sides of said flexible member on the opposite sides of said loop, whereby when said members are moved away from each other the loop is tightened to secure a stone to said chain.

4. A device for holding irregular stones for the purpose of performing mechanical operations thereon which comprises:

(a) spaced support members, (b) means mechanically associating said members operable to move said members toward and away from each other, (c) a length of flexible member mechanically associated with a portion of each of said members to form a closed loop, said flexible member lying essentially in a single plane, (d) a plurality of means on said flexible member in opposed positions to engage a stone positioned in the loop of said flexible member, (e) said flexible member comprising a pivoted link chain and said means to engage said stone comprising teeth members mounted on one side of said chain, (f) one or more stabilizer bars mounted on extended pivots of said chain across the loop formed by said chain, each end of a bar having a sliding relationship with said extended pivots, and (g) a stone engaging tooth on the end of each extended pivot, whereby when said members are moved away from each other the loop is tightened to secure a stone to said chain.

5. A device as defined in claim 4 in which said one or more bars are mounted on the same side of the chain as the stone engaging teeth to form a support platform for a stone being mounted in said loop.

6. A device for holding irregular stones for the purpose of performing mechanical operations thereon which comprises:

(a) spaced support members, (b) means mechanically associating said members operable to move said members toward and away from each other, (c) a length of flexible member mechanically associated with a portion of each of said members to form a closed loop, said flexible member lying essentially in a single plane, (d) a plurality of means on said flexible member in opposed positions to engage a stone positioned in the loop of said flexible member, (e) the means to move said support members toward and away from each other comprising a threaded shaft rotatably socketed at one end in one bar and threadingly engaging the other bar, whereby when said members are moved away from each other the loop is tightened to secure a stone to said chain.

7. A device for securely holding irregular objects such as stones for the purpose of performing mechanical operations thereon which comprises:

(a) spaced parallel, support members each comprising an elongate bar having a cross-section adapted to be clamped simultaneously in spaced relation in a support, (b) means mechanically associating said members operable to move said members toward and away from each other, said means comprising a screw having one end rotatably socketed in a first recess in one of said bars and another portion of said screw threadingly engaging a second recess in othe other of said bars, (c) a length of link chain forming a closed loop mechanically associated with said bars, the ends of said chain being pivotally anchored on opposite sides of said other bar adjacent said second recess, and the bight of said loop being interengaged with the said one of said bars adjacent said first recess, said chain loop lying essentially in a single plane, and (d) a plurality of means on said chain on one side of said plane projecting from said chain having edges to engage and secure an irregular object when said bars are moved away from each other by said rotation of said screw.

* * * * *